US005230308A

United States Patent [19]

Gauthier et al.

[11] Patent Number: 5,230,308

[45] Date of Patent: Jul. 27, 1993

[54] LOW MASS DIRECT ACTING HYDRAULIC VALVE LIFTER

[75] Inventors: Daniel G. Gauthier, E. Lansing, Mich.; Donald G. Engel, Rochester, N.Y.; John J. Krieg, Spencerport, N.Y.; Michael J. Warden, Rochester, N.Y.; Werner Herrmann, Pittsford, N.Y.; Richard K. Donoghue, Rochester, N.Y.; Gary J. De Angelis, Spencerport, N.Y.

[73] Assignee: General Motors Corporation, Detroit, Mich.

[21] Appl. No.: 978,310

[22] Filed: Nov. 17, 1992

Related U.S. Application Data

[63] Continuation of Ser. No. 877,623, May 1, 1992, abandoned, which is a continuation-in-part of Ser. No. 610,254, Nov. 8, 1990, Pat. No. 5,119,774.

[51] Int. Cl.[5] ..... F01L 1/24

[52] U.S. Cl. ..... 123/90.55; 123/90.51; 74/569

[58] Field of Search ..... 123/90.48, 90.49, 90.51, 123/90.52, 90.55, 90.56, 90.57; 74/569

[56] References Cited

U.S. PATENT DOCUMENTS

| | | | |
|---|---|---|---|
| 4,745,888 | 5/1988 | Kapp | 123/90.33 |
| 4,782,799 | 11/1988 | Goppelt et al. | 123/90.55 |
| 4,787,347 | 11/1988 | Schaeffler | 123/90.55 |
| 4,867,114 | 9/1989 | Schaeffler | 123/90.55 |
| 5,119,774 | 6/1992 | Krieg et al. | 123/90.55 |

FOREIGN PATENT DOCUMENTS

| | | | |
|---|---|---|---|
| 2093940 | 9/1982 | United Kingdom | 123/90.55 |

*Primary Examiner*—E. Rollins Cross
*Assistant Examiner*—Weilun Lo
*Attorney, Agent, or Firm*—Robert J. Outland

[57] ABSTRACT

A direct acting hydraulic valve lifter features in a preferred embodiment a follower assembled with a thin wall metal shell and a light plastic baffle to support a lash adjusting hydraulic element assembly. An inlet riser chamber has sufficient cross section to minimize oil flow restriction in cold oil conditions. Dead space between the shell and baffle is filled with a strong lightweight foam to support and retain the baffle and displace oil for low mass.

32 Claims, 4 Drawing Sheets

LOW MASS DIRECT ACTING HYDRAULIC VALVE LIFTER

This is a continuation of application Ser. No. 07/877,623 filed on May 1, 1992, now abandoned, which is a continuation-on-part of application Ser. No. 07/610,254 filed Nov. 8, 1990 and now U.S. Pat. No. 5,119,774.

TECHNICAL FIELD

This invention relates to hydraulic valve lifters (HVL's) for engines and, in more particular embodiments, to direct acting HVI's of light weight for use in relatively high speed overhead cam (OHC) automotive engines and the like. HVL's may also be referred to as hydraulic tappets and sometimes are called hydraulic lash adjusters, and direct acting hydraulic valve lifters (DAHVL's) are sometimes called bucket tappets, however these various names are not necessarily of equivalent scope.

BACKGROUND

It is known in the art relating to overhead cam (OHC) internal combustion engines to provide a direct acting hydraulic valve lifter (DAHVL) that is contacted by a cam and directly actuates one or more valves of the engine. One such arrangement which has been used production engines is shown in U.S. Pat. No. 4,745,888 issued May 24, 1988 to the assignee of the present invention.

In that patent disclosure, a camshaft 18 supported in an aluminum camshaft carrier 11 has cams 22, each of which directly engages a DAHVL (tappet 23) that in turn engages the stem 34 of a poppet valve conventionally carried in a cylinder head, not shown, to actuate the valve. Each lifter 23 includes a cup-like follower having a cam engaging alloy cast iron upper end 24 diffusion bonded to a cold formed steel baffle shell including an annular outer wall (skirt 26) and an inwardly supported central wall 27. The central wall includes a radial supporting baffle and an axial annular cylinder portion in which a hydraulic element assembly (HEA) (hydraulic lash adjuster 28) is reciprocably supported. The HEA is supplied with hydraulic fluid (engine oil) through an annular oil feed chamber 30 which is fed at its lower edge through an opening 32 via an external groove 31.

The follower construction is thin-walled to maintain a low reciprocating weight for the lifter 23 as is desirable for operation at higher engine speeds. However, the chamber 30 is filled with a significant volume of oil which increases the reciprocating mass of the lifter in operation. Also, the oil in the chamber 30 may drain from the lifter when the engine is stopped so that, upon starting, the oil supply must again fill the chamber 30 before a dependable feed of oil is again provided to the HEA 28. During this period, the HEA must rely upon an internal oil reservoir for its oil supply. In addition, air may enter the system such as through draining of the chamber 30 when the engine is stopped or foaming of the oil supply during engine operation. This air may enter the HEA through an inlet from the chamber 30, resulting in unwanted tappet noise and/or improper valve actuation for an extended period until the air is removed from the lifter by escape through the clearances apart from or along with the escaping oil.

Copending commonly assigned U.S. Pat. application Ser. No. 07/610,2454, filed Nov. 8, 1990, now U.S. Pat. No. 5,179,774 issued Jun. 9, 1992, discloses DAHVL's in which oil is displaced from the chamber 30 by oil resistant foam which reduces the operating reciprocating mass of the lifter and supports or assists in supporting the axial cylinder portion of the central wall that in turn supports the HEA. Reference to that patent application, which is incorporated herein by reference, as well as to corresponding applications elsewhere will further explain the background of the additional features included in the present invention.

SUMMARY OF THE INVENTION

The present invention involves direct acting hydraulic valve lifters (DAHVL's) which utilize the foam filler and other features of the aforementioned U.S. Pat. No. 5,119,774 while providing improvements in the cam follower construction that can reduce mass and complexity with potentially lower manufacturing cost. Among the improved features of the invention are:

A follower having an optional single piece shell combined with a light plastic baffle retained by the foam filler for low mass and cost;

Suitable for use with conventional hydraulic element assemblies (HEA's) or other piston arrangements;

A preferred polymer material for the baffle having low mass and good stability characteristics;

A riser chamber that provides a fluid inlet path and sufficient volume for maintaining pressure under cold flow. This can be formed as part of the plastic baffle and/or within the supporting foam;

Sealing and assembly means and methods for reliability and efficiency of manufacture.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
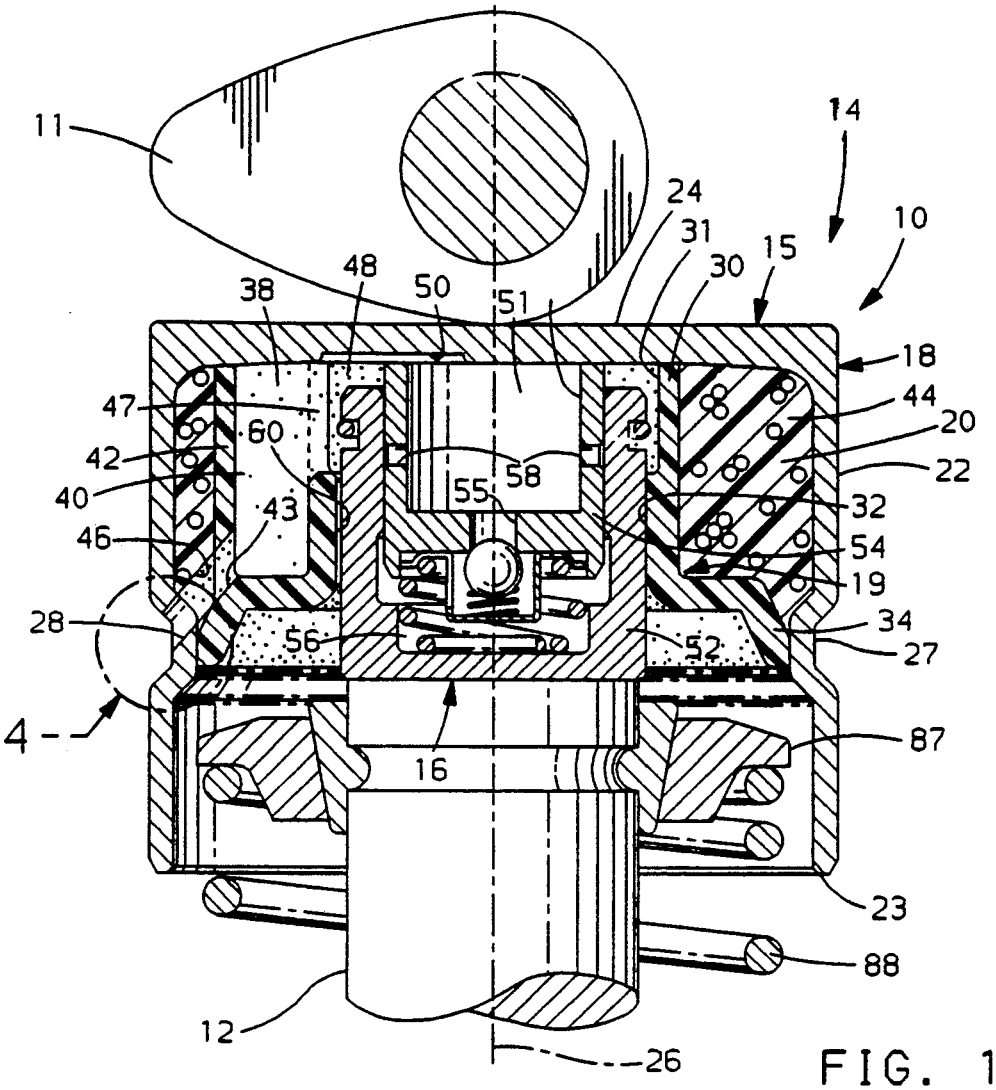
FIG. 1 is a cross-sectional view of an engine valve train incorporating a direct acting hydraulic valve lifter (DAHVL) having a riser chamber and other features according to the invention.

Referring now to FIGS. 1–4 of the drawings in detail, numeral 10 generally indicates a preferred embodiment of direct acting hydraulic valve lifter (DAHVL) according to the invention. Lifter 10 is somewhat similar in its general construction to the tappets or lifters described in the previously cited U.S. Pat. Nos. 4,745,888 and 5,119,774 and is adapted to be reciprocably mounted between a cam 11 and the stem 12 of a cylinder poppet valve in an engine 14 in a conventional manner as shown, for example, in the cited patent.

The lifter 10 comprises a cam follower 15 and a hydraulic element assembly (HEA) 16. The follower 15 includes a cup-like outer shell 18, an inner baffle 19 and a foam filler 20.

Figure 2:
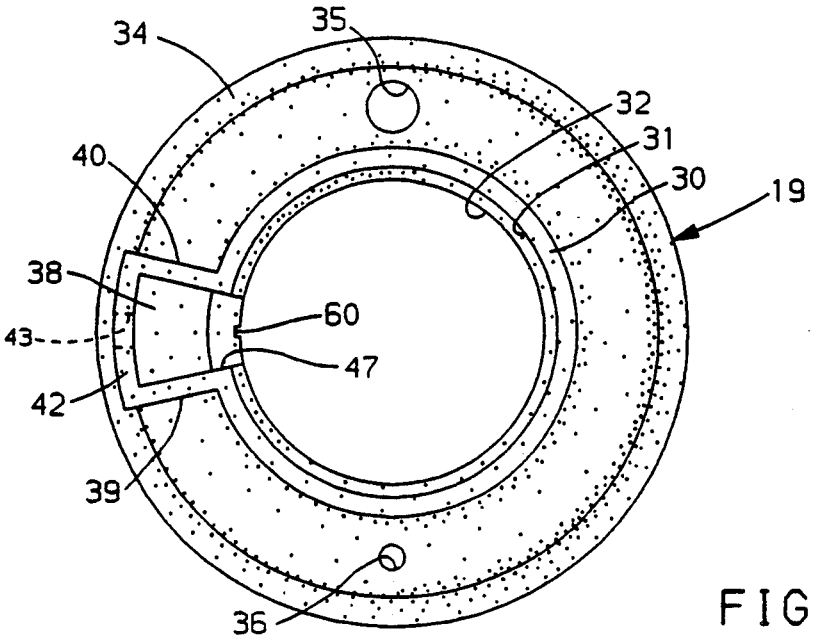
FIG. 2 is a top view of the plastic baffle member of FIG. 1.
Figure 3:
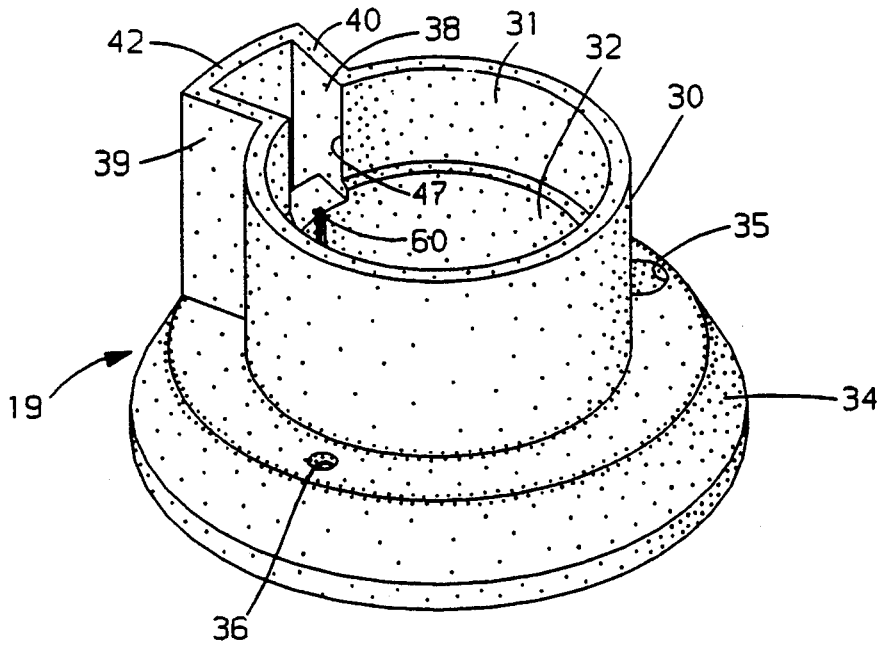
FIG. 3 is a pictorial view of the plastic baffle member of FIG. 1.

The shell 18 has an annular skirt or outer wall 22 with an open bottom end 23 and a cam-engaging head 24 closing the upper end. (The head 24 is often referred to as a foot for consistency with other valve lifters, including historical direct acting types, in which the lifter rides on top of the cam). For some applications, the head 24 may be formed of steel integral with the outer wall 22. However, where an alloy cast iron or other head material is preferred, the head 24 may be separately formed and attached to the wall 22 in any suitable manner such as, for example, by diffusion bonding or laser welding. The shell outer wall, as shown in FIG. 2, is of circular cross section centered on an axis 26, however it may be oval, rectangular or another suitable shape if desired. Between its ends, an inwardly extending annular groove 27 is formed, as by rolling or machining. An oil inlet opening 28 passes through the shell on the upper side of the groove 27.

The baffle 19 is formed separately from the shell of a suitable lightweight material and construction and is retained in the upper portion of the shell 18. Baffle 19 includes an upstanding inner wall 30 that preferably extends to the head 24 of the shell 18. The upper portion of the wall 30 forms an annular recess 31 similar to a counterbore in appearance. Below the recess, the wall 30 defines an inner cylinder 32 which is preferably of circular cross section to receive a conventional HEA. A flange 34 extends outward from the cylinder, preferably at the bottom of the wall 30. In the illustrated embodiment, the flange extends radially for part of its diameter and then slopes downward to engage the shell outer wall 22 inward of the oil groove 27. The raised central portion of the flange provides clearance for associated valve train components. The flange may include a fill hole 35 and a smaller vent hole 36 to be later discussed.

Along one side of the inner wall 30 and aligned with the inlet opening 28 are auxiliary wall means defining a riser chamber 38 extending axially along the inner wall 30 from the flange 34 to the head 24 of the shell In the FIG. 1–4 embodiment, the wall means include spaced lateral walls 39 and 40 that extend radially outwardly from the inner wall 30 and a boundary wall 42 that connects outer edges of the lateral walls between the inner and outer walls 30, 22 to define the outer extent of the riser chamber. Walls 39, 40, 42 also engage the inner side of the head 24 and extend to the flange 34 below. An inlet hole 43 through the boundary wall 42 near the flange is aligned with the opening 28 in the wall 22.

When assembled, the shell 18 and the baffle 19 define an annular first space 44 between the inner and outer walls. This space is filled with the foam filler 20 except for the riser chamber 38 which is open to the passage of oil. A passage 46 formed through the foam between the inlet opening 28 and the inlet hole 43 allows oil flow from the oil groove 27 into the riser chamber 38. A slot 47 through the upper portion of the inner wall 30 connects the riser chamber 38 with a second space 48 within the inner wall and a shallow recess 50 in the head 24 permits oil to flow from the chamber 38 through the slot 47 and recess 50 to an inner reservoir 51 in the HEA.

The features of the HEA form no part of the present invention since they are of known conventional form or are disclosed in the prior U.S. Pat. No. 5,119,774. Detailed discussion of the HEA is not therefore required. In general, however, the HEA comprises a closed end piston 52 internally carrying a plunger 54 engagable with the head 24 and having a check valve controlled orifice 55 that allows one way oil flow from the reservoir 51 to a pressure chamber 56 between the piston and plunger. The recirculation holes 58 in the plunger and clearance means formed as a flat on the piston or as a groove 60 across the cylinder 32 surface provide optional recirculation and vent means as described and claimed in the aforesaid U.S. Pat. No. 5,119,774.

Figure 4:
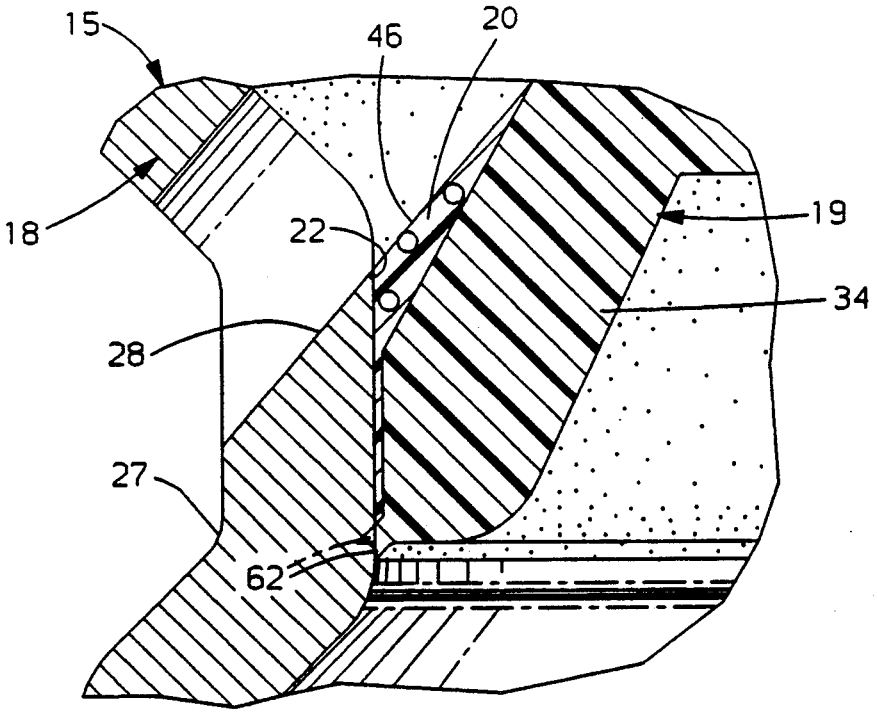
FIG. 4 is an enlarged view of the circled portion of FIG. 1 showing an optional "crush edge" sealing feature.

Another optional feature shown in FIG. 4, an enlarged view of the circled area 4 of FIG. 1, is a crush edge 62 at the lower outer edge of the baffle flange 34. Formed as a sharp edge 62 (shown in dashed lines) in the plastic material prior to assembly, the edge 62 is deformed by interference fitting within the smaller inner diameter of the outer wall 22 adjacent the oil groove 27. This tight fitting crushed edge 62 forms a seal against the escape of the foam filler during its installation in the follower first space 44.

Figure 5:
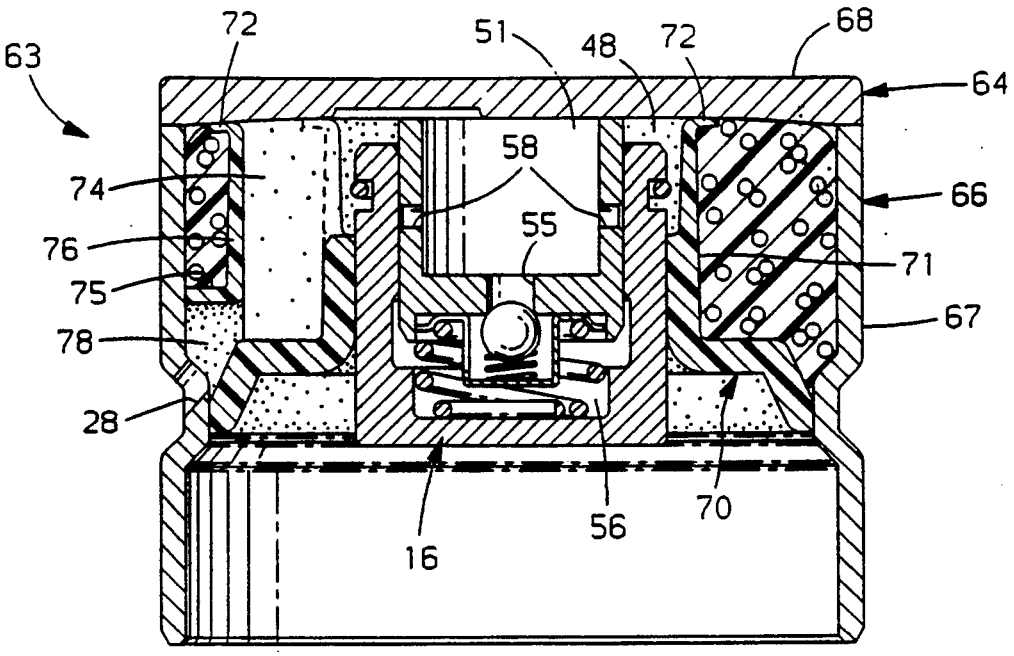
FIG. 5 is a cross-sectional view of an alternative embodiment having other optional features.

FIG. 5 shows a DAHVL 63 similar to that of FIG. 1 wherein like numerals designate like parts. Several optional features are included in a modified follower 64. A two-piece shell 66 is provided having a thin steel outer wall 67 attached, such as by diffusion bonding, to an alloy cast iron head 68. The two-piece construction is optional and similar to prior commercial valve lifters such as that shown in the aforementioned U.S. Pat. No. 4,745,888.

A baffle 70 similar to that of FIGS. 1–4 is also provided having two other modifications. The inner wall 71 has at its upper end a lip 72 extending outward and engaging an inner side of the head 68. The lip can assist in preventing leakage of foam into the second space 48 containing the HEA 16. A modified riser chamber 74 is also formed by providing an outward extension 75 from the lower portions of the auxiliary walls 76 to form an enlarged inlet portion 78. This extends the riser chamber outward and further reduces resistance to fluid flow from the inlet opening 28 to the second space 48.

In this FIG. 5 embodiment, the joint 79 between the baffle 70 and the outer wall 67, at the location of the riser chamber inlet portion 78, is sealed against oil leakage by the close fitting of the parts and, optionally, by a crushed edge 62 forming seal means as shown in FIG. 4. However, it does not have the additional sealing effect of the foam filler at this location as does the FIG. 1–4 embodiment. If desired, other types of seals could be provided as seal means to control leakage at this joint. Also, such seals as resilient rings or gaskets could be used around the baffle edges to control foam leakage during filling.

Figure 6:
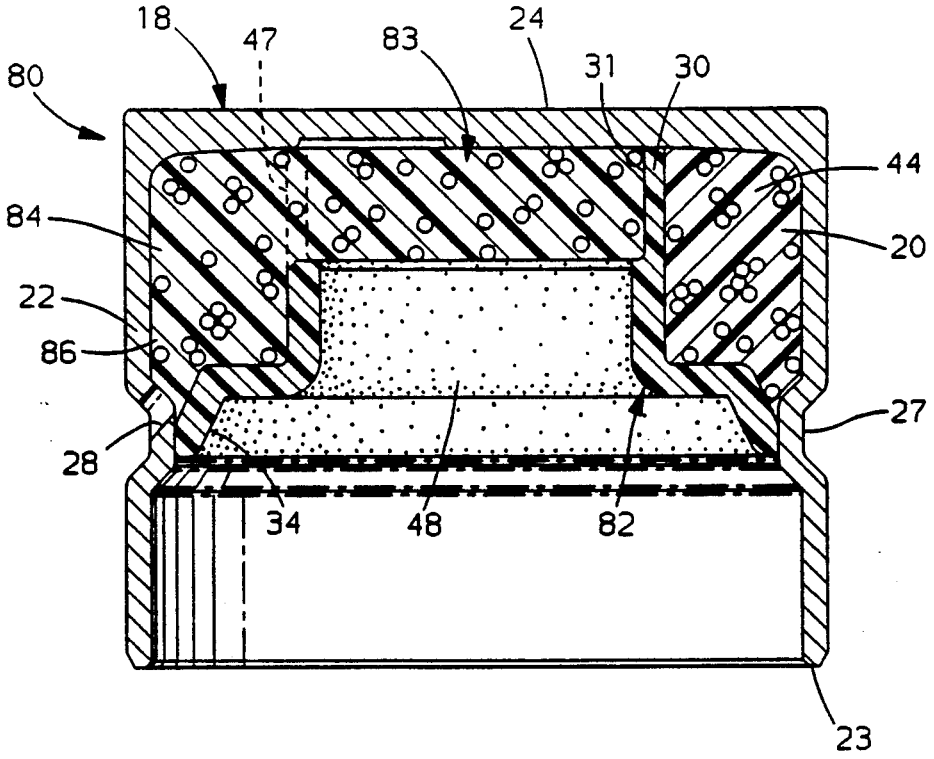
FIG. 6 is a cross-sectional view of another embodiment of follower formed with a lost core shown prior to removal.
Figure 7:
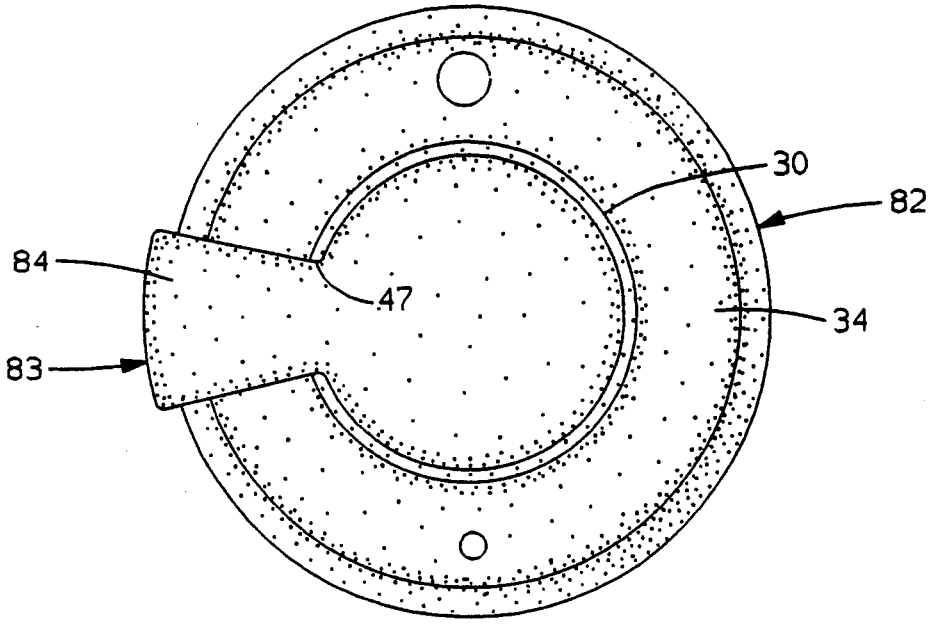
FIG. 7 is a top end view of the baffle for the embodiment of FIG. 6 showing the lost core in place prior to assembly into the shell.
Figure 8:
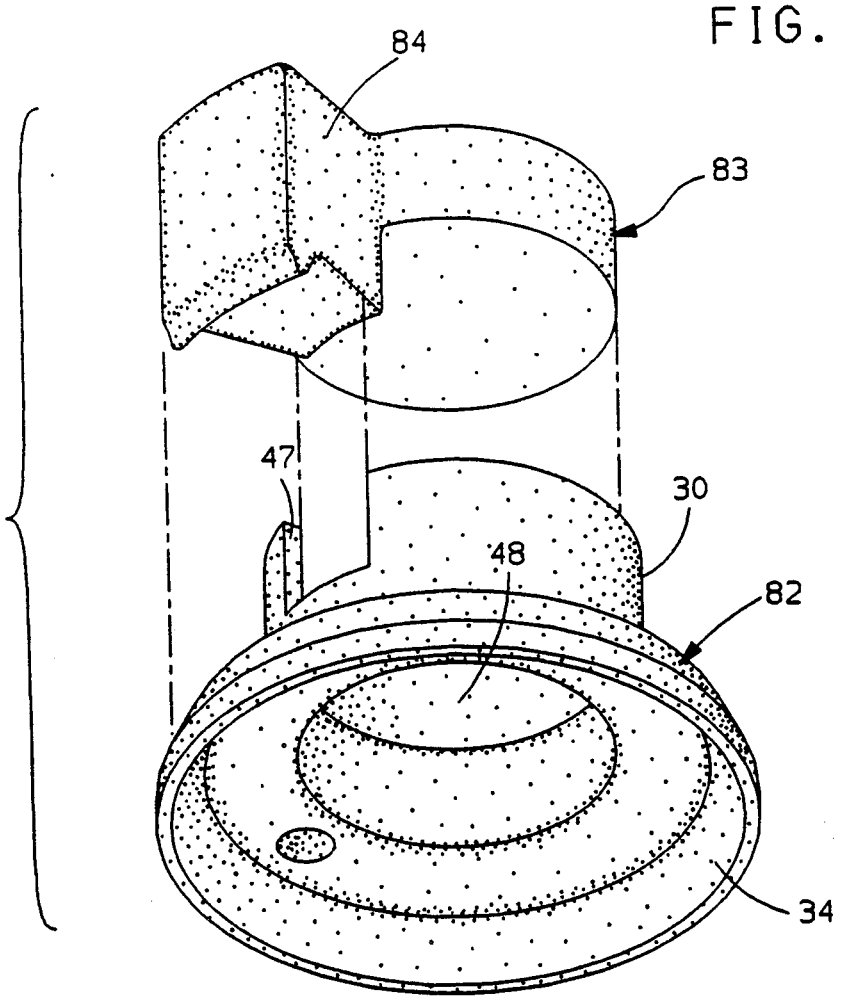
FIG. 8 is a pictorial view of the baffle of FIGS. 6 and 7 with the lost core in position for assembly.

FIG. 6 illustrates another embodiment of follower 80 for a DAHVL according to the invention. The shell 18 is optionally like that of FIG. 1 but the baffle 82 is modified to eliminate auxiliary walls. Instead, a lost core 83 is applied during manufacture as shown in FIGS. 6–8. The core 83 fits within the annular recess 31 of the inner wall 30 of baffle 82 closing the upper part of the second space 48. A small radial segment 84 of the core extends through the slot 47 in the wall 30 out to the outer wall 22 and down to the flange 34 of the baffle at the inlet opening 28 to prevent the inflow of foam filler 20 to the cored volume during the filling process. The core is subsequently removed, as will be discussed later, forming a riser chamber 86 in the first space that is bordered by the foam filler 20 and connects the inlet opening 28 with the second space 48.

In operation of the described embodiments, oil admitted through the opening 28 passes through the riser chamber 38, 74, 86, slot 47 and recess 50 to the reservoir 51. From there, it is allowed to pass through the check valved orifice 55 and refill the pressure chamber 56 at each cycle as the HEA 16 operates to adjust the valve lash in known manner, urging the follower head 24, 68 lightly against the cam 11 and the HEA piston 52 against the valve stem 12. Then as the rotating cam 11 forces the follower 15, 64, 80 downward, the HEA piston 52 opens the valve by forcing down the stem 12 and spring seat 87 against the force of the spring 88, further cam rotation again allowing the valve to close and the replacement of oil which has leaked from the pressure chamber 56.

Under warmed-up engine operation, oil flows freely into the inlet passages. However, the riser chamber 38, 74, 86 is made with sufficient cross section transverse to the direction of oil flow to avoid substantial resistance to cold oil flow and encourage normal filling of the pressure chamber even under cold starting conditions when the oil is more viscous. The recirculation holes 58 and vent groove 60, if provided, operate to minimize the entry of oil entrained air into the reservoir 51.

In manufacture of a lifter follower as in FIGS. 1–4, the shell may be cold formed from a conventional hardenable steel with the oil groove 27 being roll formed or machined as desired.

The baffle is preferably molded of a low mass polymer plastic having good dimensional control, thermal expansion stability and chemical resistance. A presently preferred example is Fortron® 6165, a highly glass reinforced and mineral filled polyphenylene sulfide (PPS) molding material available from Hoechst Celanese, Engineering Plastics Division, Summit, NJ. The groove 60, if used, may be molded into the cylinder 32 or the cylinder and groove 60 may be machined for clearance control if desired.

Alternatively, the baffle may be made from any suitable material which may be selected, for example, from among the thermoplastic and thermosetting reinforced and filled engineering plastics. Among the needed or desired characteristics of such baffle materials are durability in a lubricating oil environment at temperatures from −40° to 150° C., a coefficient of linear thermal expansion closely matched to the mating metallic components, resistance to lubricating oil contaminants and an ability to be molded with close tolerance and low warp.

After assembly of the baffle into the shell, the foam filler is installed as a liquid into the first space 44 through a nozzle inserted into the fill hole 35 in the flange 34. The filler foams and hardens in place, with air escaping from the space 44 through the vent hole 36. Leakage of foam into the second space 48 and the riser chamber 38 may be prevented if necessary by pressurizing these spaces through the inlet hole 43, the bottom of the cylinder 32 being sealed off during the process. However, the joints may be adequately sealed by engagement of the baffle and shell members, possible with the aid of crush edges such as 62 acting as seal means.

After hardening, the foam filler has sufficient strength and adhesion to retain the plastic baffle in position within the shell under engine operating conditions. A preferred selection of foam filler material is a modified polyurethane foam provided by System-Chardonol Division of Cook Composites and Polymers Co. (formerly the Freeman Chemical Company) of port Washington, WI and having a mix ration of 100 parts by Chempol® 030-A944-70 resin to 200 parts by weight Chempol® 030-2416 Isocynate.

At present, a preferred process for assembling the lifter follower includes the following steps:

1. Provide a follower shell and plastic baffle as described above, both of which should be clean and dry.
2. Heat the shell to 150° F. This helps to assure proper expansion and correct physical and mechanical properties of the cured foam.
3. Assemble the baffle into the shell, orienting the baffle riser chamber with the shell inlet opening.
4. In a fixture, clamp the baffle in the shell and seal the baffle at the shell inner diameter
5. Mix the two part foam and inject through the baffle foam fill hole.
6. When foam expansion begins, apply air pressure to baffle interior volume to prevent foam seepage thereinto.
7. Heat the follower assembly with the clamped baffle at 150° F. until the foam is cured and set.
8. When complete, remove the baffle from the clamping fixture.

Manufacture of the FIG. 5 embodiment can be essentially as above while the embodiment of FIGS. 6–8 differs in the previously described use of the lost core 83. Any suitable core material can be used which can be removed after assembly of the lifter follower Possible examples are oil or water soluble foam materials, ice, etc.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A hydraulic valve lifter capable of forming at least a portion of an engine valve train between a cam and a valve, said lifter comprising a follower having a cup-like shell with a peripheral outer wall generally parallel with an axis of reciprocation and having closed and open ends, an inner cylinder parallel with the axis and spaced within the outer wall to define a first space therebetween, filler means comprising a lightweight oil resistant foam and filling a substantial portion of said first space to block the entry of hydraulic fluid to the filled portion, a separate baffle received with said follower shell, said baffle including an inner wall incorporating said cylinder and a flange extending outward from the cylinder toward the outer wall to form, at least in part, a floor for said first space, hydraulic means in the follower including a piston guided in the cylinder and having a closed end facing away from the closed end of the shell, the closed ends of the shell and piston being adapted respectively for operative association in such valve train with the cam and valve, and inlet means in the follower for admitting hydraulic fluid to a second space between the closed ends of the shell and piston, said inlet means including an inlet opening through the outer wall intermediate its ends and a riser chamber extending axially in said first space between the inlet opening and the closed end of the shell, the riser chamber being relatively narrow but of adequate transverse cross section to avoid substantial resistance to cold oil flow and being connected to the second space near said shell closed end.

2. A hydraulic valve lifter as in claim 1 wherein said baffle inner wall extends axially to the closed end of the shell and said flange extends outward to the outer wall, said foam being retained between the baffle and the shell.

3. A hydraulic valve lifter as in claim 2 and further comprising auxiliary wall means extending laterally from the inner wall and axially to the baffle flange and the closed end of the shell to define the riser chamber, and an opening through the inner wall near the shell closed end connecting the riser chamber with the second space.

4. A hydraulic valve lifter as in claim 3 wherein the auxiliary wall means includes a connecting wall portion spaced inwardly from the shell outer wall and defining an outer extent of the riser chamber.

5. A hydraulic valve lifter as in claim 4 wherein a lower portion of the auxiliary wall means extends outward to the shell outer wall to define with the baffle flange a generally radial inlet portion of the riser chamber, said inlet means including an opening in the shell outer wall communicating with said inlet portion.

6. A hydraulic valve lifter as in claim 2 and further comprising seal means sealing a joint between the flange of the baffle and the shell outer wall.

7. A hydraulic valve lifter as in claim 6 wherein the seal means includes a crush edge comprising a narrow projecting lip on the flange, said lip being crushed during assembly of the baffle and shell to form a tight sealing fit at said joint.

8. A hydraulic valve lifter as in claim 4 wherein at least one of said inner wall and auxiliary wall means includes a lip extending outward against the closed end of the shell.

9. A hydraulic valve lifter as in claim 1 wherein said baffle is a plastic material.

10. A hydraulic valve lifter as in claim 9 wherein the plastic baffle material is selected from the group consisting of reinforced and filled thermoplastic and thermosetting engineering plastics.

11. A hydraulic valve lifter as in claim 9 wherein the plastic baffle material is a mineral/glass filled polyphenylene sulfide polymer equivalent to Fortron® 6165.

12. A hydraulic valve lifter as in claim 11 wherein the foam is equivalent to a modified polyurethane foam formed from a mix of 100 parts by weight Chempol® 030-A944-70 resin with 200 parts by weight Chempol® 030-2416 Isocyanate.

13. A hydraulic valve lifter as in claim 1 wherein the riser chamber is formed by a lost core during formation of the foam filler after which the lost core is removed.

14. A hydraulic valve lifter as in claim 13 wherein a portion of the second space adjacent the closed end of the shell is also formed by the lost core.

15. A hydraulic valve lifter capable of forming at least a portion of an engine valve train between a cam and a valve, said lifter comprising a follower having a cup-like shell with a peripheral outer wall generally parallel with an axis of reciprocation and having closed and open ends, an inner cylinder parallel with the axis and spaced within the outer wall to define a first space therebetween, hydraulic means in the follower including a piston guided in the cylinder and having a closed end facing away from the closed end of the shell, the closed ends of the shell and piston being adapted respectively for operative association in such valve train with the cam and valve, inlet means in the follower for admitting hydraulic fluid through said first space to a second space between the closed ends of the shell and piston, filter means comprising a lightweight oil resistant foam and filling a substantial portion of said first space to block the entry of hydraulic fluid to the filled portion, and a separate baffle received within said follower shell, said baffle including an inner wall incorporating said cylinder and a flange extending outward from the cylinder toward the outer wall to form, at least in part, a floor for said first space.

16. A hydraulic valve lifter as in claim 15 wherein said flange extends outward to the outer wall, said foam being retained between the baffle and the shell.

17. A hydraulic valve lifter as in claim 15 wherein said foam adheres to both the baffle and the shell to aid in retaining the baffle in the shell.

18. A follower for a hydraulic valve lifter and comprising a cup-like shell with a peripheral outer wall generally parallel with an axis of reciprocation and having closed and open ends, a separate baffle received within said shell, said baffle including an inner wall defining an inner cylinder, said inner cylinder being parallel with the axis and spaced within the outer wall to define a first space therebetween, and a flange extending outward from the cylinder toward the outer wall to form, at least in part, a floor for said first space, inlet means in the follower for admitting hydraulic fluid through said first space to a second space extending radially within the cylinder and adjacent the closed end of the follower, and filler means comprising a lightweight oil resistant foam filling a substantially portion of said first space to block the entry of hydraulic fluid to the filled portion.

19. A follower for a hydraulic valve lifter as in claim 18 wherein said foam adheres to both the baffle and the shell to aid in retaining the baffle in the shell.

20. A follower for a hydraulic valve lifter as in claim 18 wherein said flange extends outward to the outer wall, said foam being retained between the baffle and the shell.

21. A follower for a hydraulic valve lifter as in claim 18 and further comprising seal means sealing a joint between the flange of the baffle and the shell outer wall.

22. A follower for a hydraulic valve lifter as in claim 21 wherein the seal means includes a crush edge comprising a narrow projecting lip on the flange, said lip being crushed during assembly of the baffle and shell to form a tight sealing fit at said joint.

23. A follower for a hydraulic valve lifter as in claim 18 wherein said baffle inner wall extends axially to the closed end of the shell.

24. A follower for a hydraulic valve lifter as in claim 18 wherein said inner wall includes a lip extending outward against the closed end of the shell.

25. A follower for a hydraulic valve lifter as in claim 18 wherein said baffle is a plastic material.

26. A follower for a hydraulic valve lifter as in claim 25 wherein the plastic baffle material is selected from the group consisting of reinforced and filling thermoplastic and thermosetting engineering plastics.

27. A follower for a hydraulic valve lifter as in claim 25 wherein the plastic baffle material is a mineral/glass filled polyphenylene sulfide polymer equivalent to Fortron® 6165.

28. A follower for a hydraulic valve lifter as in claim 27 wherein the foam is equivalent to a modified polyurethane foam formed from a mix of 100 parts by weight Chempol® 030-A044-70 resin with 200 parts by weight Chempol® 030-2416 Isocyanate.

29. A follower for a hydraulic valve lifter as in claim 18 wherein said inlet means includes an inlet opening through the outer wall intermediate its ends and passage means through said first space and connecting the inlet opening to the second space near said shell closed end.

30. A follower for a hydraulic valve lifter as in claim 18 wherein the passage means includes a riser chamber extending axially in said first space between the inlet opening and the closed end of the shell, the riser chamber being relatively narrow but of adequate transverse cross section to avoid substantial resistance to cold oil flow and being connected to the second space near said closed end.

31. A follower for a hydraulic valve lifter as in claim 30 wherein the riser chamber is formed by a lost core during formation of the foam filler after which the lost core is removed.

32. A follower for a hydraulic valve lifter as in claim 31 wherein a portion of the second space adjacent the closed end of the shell is also formed by the lost core.

* * * * *